US007416047B2

(12) United States Patent
Frasl et al.

(10) Patent No.: US 7,416,047 B2
(45) Date of Patent: Aug. 26, 2008

(54) DIAPHRAGM FOR A LOUDSPEAKER WITH A MOVING COIL

(76) Inventors: Ewald Frasl, Buchenweg 1/2, A-2362 Biedermannsdorf (AT); Helmut Wasinger, Giesshueblerstrasse 21/3/54, A-2371 Hinterbruehl (AT)

( * ) Notice: Subject to any disclaimer, the term of this patent is extended or adjusted under 35 U.S.C. 154(b) by 192 days.

(21) Appl. No.: 11/587,236

(22) PCT Filed: Apr. 19, 2005

(86) PCT No.: PCT/IB2005/051272

§ 371 (c)(1),
(2), (4) Date: Oct. 23, 2006

(87) PCT Pub. No.: WO2005/107315

PCT Pub. Date: Nov. 10, 2005

(65) Prior Publication Data

US 2007/0209866 A1 Sep. 13, 2007

(30) Foreign Application Priority Data

Apr. 29, 2004 (EP) ..... 04101835

(51) Int. Cl.

| | |
|---|---|
| ***H04R 7/02*** | (2006.01) |
| ***H04R 7/14*** | (2006.01) |
| *G10K 13/00* | (2006.01) |
| *H04R 7/12* | (2006.01) |

(52) U.S. Cl. ..... 181/173; 381/423; 381/424

(58) Field of Classification Search ..... 181/164, 181/165, 167–174; 381/392, 398, 423, 424, 381/426–432

See application file for complete search history.

(56) References Cited

U.S. PATENT DOCUMENTS 1,640,330 A * 8/1927 Lakhovsky ..... 181/164

(Continued)

FOREIGN PATENT DOCUMENTS

GB 1 488 541 10/1977

(Continued)

*Primary Examiner*—Edgardo San Martin
(74) *Attorney, Agent, or Firm*—Peter Zawilski

(57) ABSTRACT

A preferably elongated loudspeaker (LS), which preferably comprises a cylindrical moving coil (SP) and an elongated diaphragm (M) with an elongated fastening part (B) and an annular retaining part (H) lying within the fastening part (B), and with corrugations (S1) extending in radial directions, wherein the diaphragm (M) comprises an arrangement for reducing its stiffness in at least one narrow region (SM1, SM2), which arrangement is present between the fastening part (B) and the retaining part (H). In a preferred embodiment comprising an arrangement of the corrugations (S1) in the at least one narrow region (SM1, SM2) the corrugation density is smaller than the corrugation density in at least one wide region (BM1, BM2). Preferably, the diaphragm (M) furthermore comprises an additional corrugation (S2) in the at least one narrow region (SM1, SM2), which additional corrugation (S2) extends transversely to radial directions. The above measures serve to reduce the stiffness of the diaphragm (M) locally so as to minimize disadvantageous mechanical forces exerted by the diaphragm (M) on the moving coil (SP).

11 Claims, 3 Drawing Sheets

U.S. PATENT DOCUMENTS

| | | | | | |
|---|---|---|---|---|---|
| 1,732,351 | A | * | 10/1929 | Borkman | 181/173 |
| 1,734,624 | A | * | 11/1929 | Harrison | 181/163 |
| 1,870,417 | A | * | 8/1932 | Mallina | 181/170 |
| 1,918,422 | A | * | 7/1933 | Nystrom | 181/168 |
| 1,990,409 | A | * | 2/1935 | Athol | 181/164 |
| 2,302,178 | A | * | 11/1942 | Brennan | 181/169 |
| 2,439,665 | A | * | 4/1948 | Marquis | 181/169 |
| 2,531,634 | A | * | 11/1950 | Lawrance | 181/164 |
| 2,960,177 | A | * | 11/1960 | Haerther, Jr. | 181/164 |
| 3,132,713 | A | * | 5/1964 | Seeler | 381/423 |
| 3,342,286 | A | * | 9/1967 | Staffen | 181/164 |
| 4,321,434 | A | * | 3/1982 | Irie | 181/173 |
| 4,581,496 | A | * | 4/1986 | Sweany | 381/429 |
| 4,881,617 | A | * | 11/1989 | Faraone | 181/164 |
| 5,847,332 | A | * | 12/1998 | Faraone | 181/164 |
| 6,510,232 | B2 | * | 1/2003 | Frasl | 381/423 |
| 6,594,372 | B2 | * | 7/2003 | Nakaso | 381/396 |
| 6,654,475 | B2 | * | 11/2003 | Nakaso | 381/396 |
| 6,920,957 | B2 | * | 7/2005 | Usuki et al. | 181/173 |
| 6,957,714 | B2 | * | 10/2005 | Takahashi et al. | 181/171 |
| 7,306,073 | B2 | * | 12/2007 | Frasl | 181/173 |
| 2005/0041830 | A1 | * | 2/2005 | Takewa et al. | 381/410 |
| 2005/0180592 | A1 | * | 8/2005 | Miura | 381/401 |
| 2005/0226456 | A1 | * | 10/2005 | Tabata et al. | 381/398 |
| 2006/0008111 | A1 | * | 1/2006 | Nagaoka | 381/423 |
| 2007/0047757 | A1 | * | 3/2007 | Yang et al. | 381/423 |
| 2007/0053547 | A1 | * | 3/2007 | Ando | 381/430 |

FOREIGN PATENT DOCUMENTS

| | | | | |
|---|---|---|---|---|
| JP | 60220699 | A | * | 11/1985 |
| JP | 63 274296 | | | 11/1988 |
| JP | 06269086 | A | * | 9/1994 |
| JP | 09 224297 | | | 8/1997 |

* cited by examiner

DIAPHRAGM FOR A LOUDSPEAKER WITH A MOVING COIL

FIELD OF THE INVENTION

The invention relates to a diaphragm for a loudspeaker, which diaphragm comprises an annular fastening part and an annular retaining part, one of said two parts lying within the other of said two parts, wherein measurable minimum distances obtain between the retaining part and the fastening part, different in value from one minimum distance to another minimum distance, such that at least one wide region and at least one narrow region are present, and wherein the diaphragm comprises corrugations, which corrugations are provided between the retaining part and the fastening part and extend in corrugation directions from the interior to the exterior.

The invention further relates to a loudspeaker with a diaphragm as described above in the first paragraph.

The invention further relates to a device with a loudspeaker as mentioned above in the second paragraph.

BACKGROUND OF THE INVENTION

For reasons of miniaturization of devices and also for reasons of economy, the demand for very small, but nevertheless high-power loudspeakers of external diameters of 50 mm, 30 mm, 15 mm, 10 mm down to 6 mm is continually rising. Synthetic resin foils are mainly used for the manufacture of diaphragms of loudspeakers of this size, the material used being in particular polycarbonate or alternatively polyarylate in material thicknesses from approximately 8 μm up to 150 μm. Corrugations are provided for these diaphragms which stabilize the diaphragms mechanically, because the corrugations counteract bending of the diaphragm, while at the same time they support the diaphragm in achieving a maximum stroke.

For this purpose, for example, corrugations leading from the inside to the outside are known which are provided in approximately radial directions and which are straight or curved in shape. Usually, the corrugations extend so as to radiate away from the retaining part of the diaphragm provided for retaining the moving coil to the fastening part of the diaphragm provided for fastening the diaphragm, and are evenly distributed over the diaphragm, for example at equal angular distances. The cross-section of the corrugations is then, for example, V-shaped, the cross-section in the center of each corrugation often being greater than at the ends of the corrugation.

The radiating arrangement of the corrugations provides the necessary longitudinal compensation within the diaphragm, when the latter is made to move during operation of a loudspeaker. Usually, in fact, a diaphragm comprises a vaulty sound-generating surface, which corresponds approximately to a toroidal surface having a circular cross-section. As a result, a point lying on the sound-generating surface of the diaphragm moves partly in radial direction during a movement of this diaphragm, which leads to a change in circumference of the circular arc passing through said point. The longitudinal compensation necessary for a maximum stroke of the diaphragm, and thus for a maximum acoustic strength, is made possible by the corrugations extending in radial directions, which corrugations narrow or widen to a greater or lesser degree each time.

It should be noted here that corrugations in a radiating arrangement are usually also provided in the vaulty sound-generating surface of the diaphragm in the case of elongated loudspeakers with an elongated diaphragm, so as to achieve the said longitudinal compensation upon a movement of the sound-generating surface of the diaphragm. Such a compensation, however, is not necessary in those portions of the diaphragm in which the edges or longitudinal sides of the retaining part and of the fastening part run mutually parallel, because points lying on the diaphragm do not move over a toroidal surface but over a cylindrical surface upon a movement of the diaphragm, which obviously does not lead to a change in distance between the points. Corrugations perpendicular to the cylinder axis, moreover, would hamper rather than facilitate the rolling movement of the cylindrical surface resulting from a movement of the diaphragm.

In contrast to circular loudspeakers, the operation of elongated loudspeakers leads to problems because of the asymmetry explained above, owing to the asymmetrical mechanical load on the moving coil connected to the retaining part of the diaphragm. During vibration of the diaphragm, in fact, radial forces of different values act on the moving coil, and the diaphragm may be warped, said forces leading to an unfavorable mechanical load on the moving coil. The frequently used high-pressure deep-drawing process, in which a synthetic resin foil is heated up to the glass transition temperature of approximately 220° C. and is subsequently pressed onto a die under a pressure of 20 bar to 25 bar, also leads to an intensification of the problem. The difference in longitudinal stretching of the diaphragm tends to make the thickness of the diaphragm in the at least one narrow region greater than in the at least one wide region, which unfortunately contributes to an undesirably high stiffness in the at least one narrow region.

Life problems occur in particular in the case of self-supporting moving coils, i.e. moving coils in which the individual turns are connected by means of only small quantities of adhesive. The individual turns are interconnected in the manufacture of the moving coil in that a basic coil manufactured from a coated coil wire is heated, which leads to liquidizing and subsequent adhesion of the lacquer-type layer provided on the coil wire. The moving coils thus manufactured, however, can be exposed to weak mechanical loads only because of the small adhesion surface areas between the individual turns.

Elongated loudspeakers with elongated diaphragms are accordingly provided with comparatively small cylindrical moving coils in relation to the smallest dimension of the elongated diaphragm, in order to keep disadvantageous mechanical influences on the moving coil as small as possible, because this makes the difference between the various radial forces comparatively small, and the mechanical load on the moving coil can thus be kept within acceptable limits. A small coil diameter of the moving coil, however, is not in accordance with the requirement of a magnet system that is as large as possible, which is necessary for achieving a maximum acoustic output.

In the prior art, therefore, elongated, preferably oval moving coils are used for elongated loudspeakers so as to avoid the problems described above. The constant distance between the retaining part for retaining the moving coil and the fastening part for fastening the diaphragm to a housing of the loudspeaker rendered possible thereby achieves that the mechanical forces exerted by the diaphragm on the moving coil during a movement of the diaphragm takes place centrally symmetrically, and is accordingly practically equally great all round. Oval moving coils, however, are much more difficult to manufacture than circularly cylindrical moving coils and require a high-precision mounting so as to achieve an exact angular relative position of the moving coil with respect to the magnet system of the loudspeaker. This is necessary because the air gap in the magnet system for accommodating the moving coil is made as narrow as possible so as to achieve as high as possible an efficiency, and a small angular misalignment of the moving coil in the air gap already can lead to a malfunction of the loudspeaker and to damage or even destruction of the moving coil. The effort required for avoiding the above risks renders the manufacture of such loudspeakers with such diaphragms much more expensive, which leads to competitive disadvantages because of the price pressure in particular in the field of small consumer electronics devices.

Different distances between the retaining part for the moving coil and the fastening part for fastening the diaphragm are also present in an elongated loudspeaker with an elongated diaphragm and with a cylindrical moving coil. It is known to choose the bulge of the diaphragm in the region of the two narrow regions present in this case to be greater than that in the region of the two wide regions present in this case in order to render it possible to obtain the same axial stroke all round for the retaining part provided for retaining the moving coil. The rolling movement occurring here upon a movement of the diaphragm and discussed above is accordingly more intensive in the two narrow regions than in the two wide regions. For this reason, and also because the torque causing the rolling movement is smaller in the two narrow regions because of the shorter lever arm than in the two wide regions, the diaphragm is deformed with greater difficulty in the two narrow regions than in the two wide regions. This leads to warping of the diaphragm and accordingly to warping of the basically planar formed retaining part as well as to radial deformations of the retaining part.

OBJECT AND SUMMARY OF THE INVENTION

The object of the invention is now to eliminate the problems mentioned above in a diaphragm as described in the opening paragraph, in a loudspeaker as described in the second paragraph, and in a device as described in the third paragraph, so as to realize an improved diaphragm, an improved loudspeaker, and an improved device.

To achieve the above object, inventive features are provided in a diaphragm according to the invention such that a diaphragm according to the invention can be characterized as follows.

A diaphragm for a loudspeaker, which diaphragm comprises an annular fastening part and an annular retaining part, one of said two parts lying within the other of said two parts, wherein measurable minimum distances obtain between the retaining part and the fastening part, different in value from one minimum distance to another minimum distance, such that at least one wide region and at least one narrow region are present, and wherein the diaphragm comprises corrugations, which corrugations are provided between the retaining part and the fastening part and extend in corrugation directions from the interior to the exterior, and wherein reducing means are provided for reducing the stiffness of the diaphragm in its at least one narrow region.

To achieve the above object, further a loudspeaker according to the invention is provided with a diaphragm according to the invention as described above.

To achieve the above object, further a device according to the invention is provided with a loudspeaker according to the invention as mentioned above.

The provision of the reducing means for reducing the stiffness of the diaphragm according to the invention achieves in a constructionally simple manner that the deformation resistance in the at least one narrow region of the diaphragm is reduced as compared with the deformation resistance in the at least one wide range, so that during operation of the loudspeaker according to the invention comprising a diaphragm according to the invention no undesirable forces are exerted on the retaining part of the diaphragm, and accordingly the axial movement of the retaining part of the diaphragm is equally great along the entire retaining part, and the retaining part of the diaphragm is not warped, so that the moving coil connected to the retaining part is advantageously not exposed to any undesirable, disadvantageous forces and accordingly always retains its cylindrical shape, performing an exactly linear axial movement in the air gap of the magnet system of the loudspeaker according to the invention.

This means that comparatively large cylindrical coils, in particular self-supporting coils, can be used for elongated loudspeakers, which coils have a good efficiency in combination with an ease of manufacturing and handling, while they also have a satisfactorily long life when used in combination with a diaphragm according to the invention. The invention is also suitable for use with so-termed sack diaphragms in which the moving coil is incorporated in a recess of the diaphragm provided for this purpose, although the stability problem relating to the moving coil is slightly less prominent in such sack diaphragms.

It was found to be advantageous in the solutions according to the invention when the reducing means in the at least one narrow region are formed by a particular arrangement of the corrugations, in which arrangement the corrugation density is smaller than the corrugation density in the at least one wide region. The desired equalization of the mechanical properties, in particular the stiffness properties of the diaphragm in longitudinal and transverse directions, and thus the desired equality of the forces acting on the moving coil are achieved in a constructionally particularly simple manner in this advantageous embodiment.

The smaller corrugation density of the corrugations in the at least one narrow region of the diaphragm in fact renders this narrow region more pliable than the at least one wide region, which achieves that the stiffness or deformation resistance has mutually similar values, and in the ideal case even identical values, in the at least one narrow region and in the at least one wide region of the diaphragm.

It is furthermore advantageous here when the corrugation density in the at least one narrow region is only half that in the at least one wide region. Irregularly distributed corrugations are usually more difficult to manufacture than regularly distributed corrugations. To achieve a sensible compromise between technical effort and the effect achieved thereby, the density ratio indicated above for the corrugations is suggested as a lower limit. The necessity of the measure will also be strongly dependent on the side ratio of the loudspeaker, why an unequal distribution of the corrugations in the case of almost rotationally symmetrical loudspeakers would definitely seem to be less important.

It was found to be particularly advantageous in the inventive solutions with a lower corrugation density in the at least one narrow region when the corrugation density in the at least one narrow region has a zero value. A corrugationless stiffness reduction portion is provided in each narrow region in these solutions, which is advantageous for achieving as simple an arrangement as possible.

It was found to be particularly advantageous in the inventive solutions as described above when the reducing means in the at least one narrow region comprise at least one additional corrugation, which additional corrugation extends in a direction such that said direction and the corrugation directions of the corrugations adjoining the additional corrugation intersect in at least two points. The at least one additional corrugation further contributes to an equalization of the mechanical properties, in particular the stiffness, in the at least one narrow region and in the at least one wide region. The at least one additional corrugation in the at least one narrow region further reduces the stiffness in this narrow region, so that the equalization of the deformation resistance is made easier in a simple manner.

It is also possible to realize a diaphragm according to the invention which is provided with corrugations extending from the inside to the outside, i.e. radially, both in its at least one narrow region and in its at least one wide region, and which in addition is provided with one or two additional corrugations in its at least one narrow region, which additional corrugations extend transversely to the corrugations extending from the inside to the outside, i.e. radially.

A combination of the two possibilities mentioned above is also advantageous, wherein on the one hand the radially extending corrugations in the at least one wide region are more densely arranged than in the at least one narrow region, while on the other hand additional corrugations are provided in the at least one narrow region of the diaphragm, which do not extend in radial directions from the inside to the outside, but transversely to the radial directions. This arrangement is equally advantageous with regard to achieving as equal as possible a mechanical load on the moving coil, so that a long useful life of the moving coil is safeguarded.

It was found to be advantageous in the inventive solutions with additional corrugations when the retaining part is given a circular shape, and when the additional corrugation is given the shape of a circular arc so as to run parallel to an adjoining zone of the retaining part. The provision of such an additional corrugation, which to a certain extent represents a joint within the diaphragm, in the immediate vicinity of the retaining part for the moving coil, and accordingly in the immediate vicinity of the moving coil itself, here leads to a particularly satisfactory load relief of the moving coil.

It is furthermore favorable when the at least one additional corrugation in the at least one narrow region is given a linear shape so as to extend parallel to a tangent to the retaining part. Such an additional corrugation has approximately the same effect as the circular additional corrugation mentioned above, but it is technically somewhat simpler to manufacture.

It is also advantageous when the at least one additional corrugation has a U-shaped cross-section. This is because it may arise, depending on the construction of a diaphragm according to the invention, that an additional corrugation hits against or crosses a radially extending corrugation, which is usually V-shaped. If a V-shaped cross-section is also chosen for the additional corrugation in such a case, comparatively sharp corners will be present in the intersection regions, which sharp corners will reduce the useful life of the diaphragm. If a L-shaped cross-section is chosen, however, softer transitions are obtained in the intersection regions, with the result that the mechanical loads in these intersection regions are also small, which is advantageous for achieving a long life of the diaphragm. Nevertheless, V-shaped cross-sections of the additional corrugations are also possible.

It is furthermore also advantageous when the additional corrugation has the same cross-section throughout its entire longitudinal dimension. Advantageously, such additional corrugations are usually simpler to manufacture than corrugations with a changing cross-section.

It is furthermore also advantageous when the retaining part is given the shape of a circle. This renders possible in an advantageous manner the use of a circularly cylindrical moving coil, which is simple to manufacture, in a loudspeaker according to the invention.

As it was noted above, it is advantageous when a device according to the invention comprises a loudspeaker according to the invention. The fact that small and nevertheless high-power, elongated loudspeakers can be manufactured in a cost-effective manner with the use of a diaphragm according to the invention obviously also has its influence on the size and price of the devices according to the invention provided therewith.

The above and further aspects of the invention will become apparent from the description of embodiments given below and are clarified with reference to these embodiments.

BRIEF DESCRIPTION OF THE DRAWINGS

The invention will now be explained in more detail with reference to two embodiments shown in the drawing, to which embodiments, however, the invention is not limited.

DESCRIPTION OF EMBODIMENTS

Figure 1A:
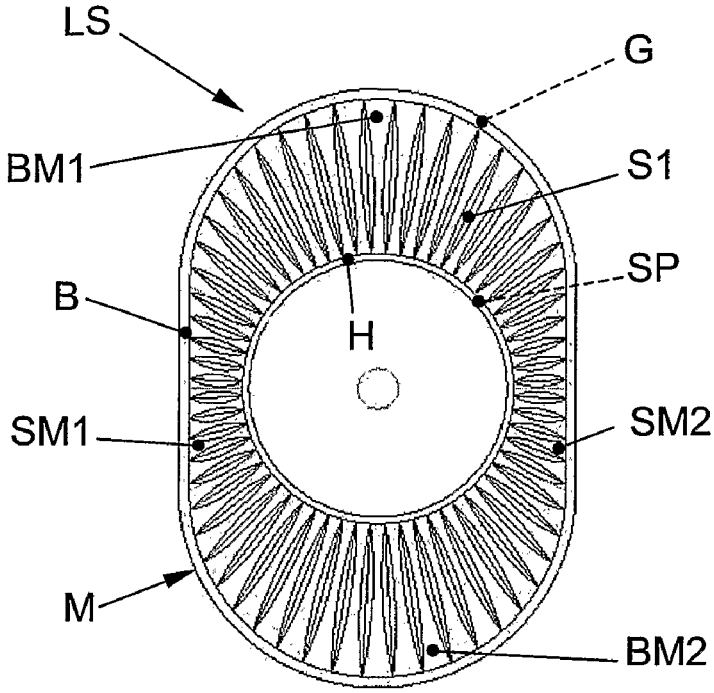
FIG. 1*a* is a plan view of a loudspeaker according to the prior art, with a diaphragm according to the prior art.

FIG. 1*a* shows a loudspeaker LS according to the prior art, comprising a diaphragm M according to the prior art. The loudspeaker LS has a housing G, the diaphragm M being connected to said housing G by means of an annular, elongated fastening part B, which is oval in shape in the present case, and an adhesive. The housing G as shown in FIG. 1 is entirely covered by the diaphragm M. A magnet system (not shown in FIG. 1*a*) is accommodated in the housing G, with which magnet system a moving coil SP co-operates. The moving coil SP is connected to an annular retaining part H of the diaphragm M by means of an adhesive, which retaining part H in this case lies inside the fastening part B. The annular retaining part H of the diaphragm M is circular in shape, corresponding to the circularly cylindrical shape of the moving coil SP. The annular fastening part B is oval in shape, but it may alternatively be shaped as an ellipse or rectangle with rounded corner regions. Because of the shapes thus arranged, there are different distances between the fastening part B and the retaining part H, i.e. in the present case two diametrically opposed wide diaphragm portions, i.e. two wide regions BM1 and BM2, and two diametrically opposed narrow diaphragm portions, i.e. two narrow regions SM1 and SM2, which four diaphragm portions BM1, SM2, BM2, and SM1 merge fluently into one another. The fastening part B and the retaining part H extend in one plane, whereas the two wide diaphragm portions, i.e. the two wide regions BM1 and BM2, and the two narrow diaphragm portions, i.e. the two narrow regions SM1 and SM2, are given a vaulted shape. The fastening part B and the retaining part H each have a closed annular shape. An alternative arrangement is possible, however, in which the retaining part has an interrupted annular shape, an empty zone being present between two retaining part zones.

Figure 1B:
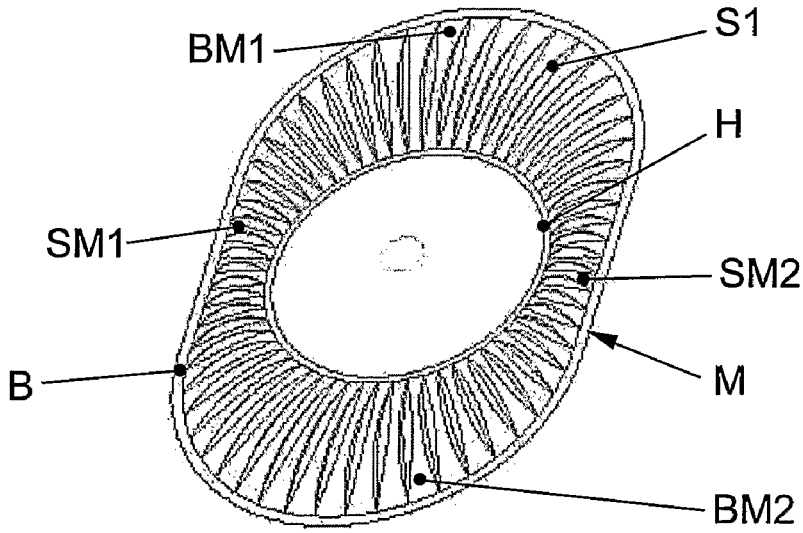
FIG. 1*b* is a perspective view of the diaphragm of the loudspeaker of FIG. 1*a*.

The diaphragm M is provided with corrugations S1, which corrugations S1 extend in corrugation directions from the inside to the outside in relation to the retaining part H and accordingly to the moving coil SP, i.e. substantially radially, and which corrugations S1 are linear in shape and lie one next to the other in a regular arrangement so as to extend from the retaining part H up to the fastening part B. The corrugations S1 are thus regularly distributed both in the two narrow regions SM1 and SM2 and in the two wide regions BM1 and BM2. The corrugations S1 fulfill a local stiffening function for the diaphragm M. FIG. 1*b* only shows the diaphragm M of the loudspeaker LS of FIG. 1*a*.

Figure 2A:
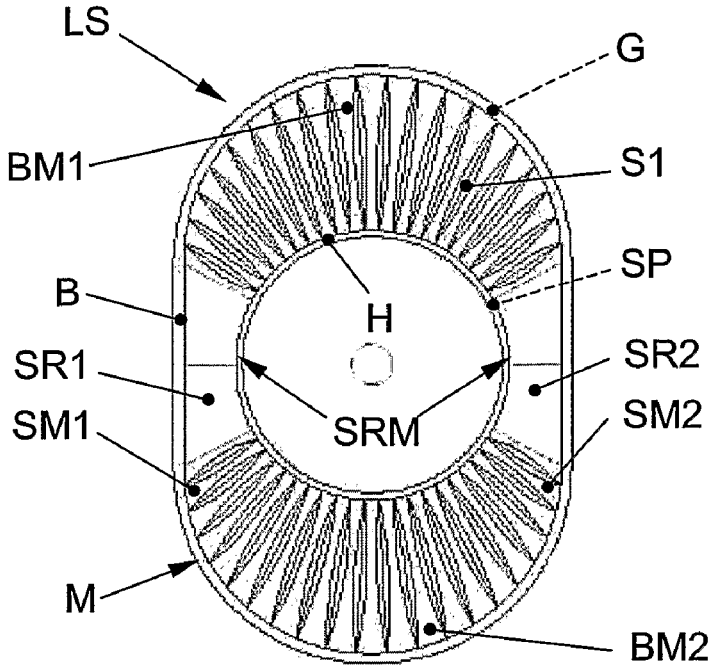
FIG. 2*a* shows in the same manner as FIG. 1*a* a loudspeaker with a diaphragm in a first embodiment of the invention, which diaphragm comprises radially extending corrugations in two width regions of the diaphragm.

FIG. 2*a* shows a loudspeaker LS according to the invention with a diaphragm M according to the invention. Corrugations S1 provided for stiffening purposes are not arranged next to one another in a homogeneous distribution; an even distribution is present in the region of the two wide diaphragm portions, i.e. the two wide regions BM1 and BM2, whereas an uneven distribution obtains in the region of the two narrow diaphragm portions, i.e. the two narrow regions SM1 and SM2, which is achieved in that no corrugations at all are provided in the respective centers of the two narrow regions SM1 and SM2. The corrugations S1 provided extend in radial directions with respect to the retaining part H away from the retaining part H outwards up to the fastening part B of the diaphragm M. The radially extending corrugations S1 thus provided here extend directly up to the retaining part H and the fastening part B. The ends of the corrugations S1 may alternatively terminate at a somewhat greater distance from the retaining part H and the fastening part B. The corrugations S1 have a V-shaped cross-section in the present case. An alternative, in particular undular shape is also possible, however.

Figure 2B:
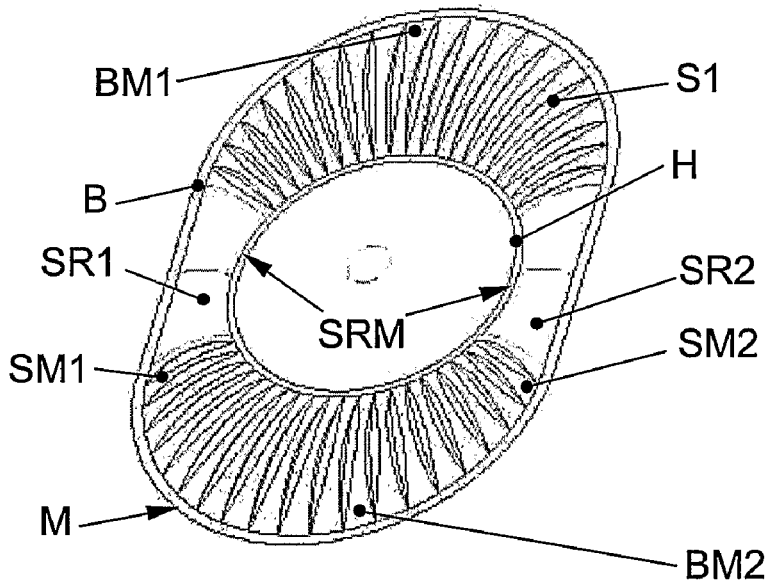
FIG. 2*b* shows in the same manner as FIG. 1 the diaphragm of the loudspeaker of FIG. 2*a*.

It is also apparent from FIGS. 2*a* and 2*b* that the cross-section of the corrugations S1 is not constant but greater in the center of each corrugation S1 than at the two ends of each corrugation S1. This cross-sectional gradient is advantageous because a stronger stiffening effect is achieved in the center of each corrugation S1, and accordingly the suppression of an undesirable crinkling of the diaphragm M is greatest in the center of each corrugation S1.

As was noted above, no corrugations are provided in part in the region of the two narrow diaphragm portions, i.e. in the two narrow regions SM1 and SM2, ie. in the centers thereof, so that a stiffness-reducing portion SR1, SR2 without corrugations is present in the region of each respective center. The two stiffness-reducing portions SR1 and SR2 together form stiffness-reducing means, i.e. reducing means SRM for reducing the stiffness of the diaphragm M in its two narrow regions SM1 and SM2. The diaphragm M thus comprises the reducing means SRM in its two narrow regions SM1 and SM2, which means serve to reduce the stiffness of the diaphragm M in the two narrow regions SM1 and SM2. The constructional arrangement chosen for the reducing means SRM is the corrugationless realization of the two stiffness-reducing portions SR1 and SR2 in this case. The provision of the reducing means SRM achieves a reduction in stiffness of the diaphragm M in its two narrow regions SM1 and SM2, in which two narrow regions SM1 and SM2 the diaphragm M is comparatively stiff because of the comparatively small distance between the retaining part H and the fastening part B. The mechanical properties of the diaphragm M in the two narrow regions SM1 and SM2 and in the two wide regions BM1 and BM2 are mutually equalized by the reducing means SRM. The omission of corrugations in the region of the stiffness-reducing portions SR1 and SR2 according to the invention advantageously achieves that no uneven load on the moving coil SP occurs during operation of the loudspeaker LS in spite of the elongated construction of the diaphragm M and the circular construction of the retaining part H of the diaphragm M, which is advantageous for obtaining as precise as possible an axial movement of the moving coil SP, as low as possible a mechanical load on the fragile moving coil SP, and as long as possible a useful life of the moving coil SP.

Obviously, a less abrupt change in the corrugation density of the corrugations S1, i.e. a less abrupt transition between a corrugationless and a corrugation region is possible, in which transition, for example, the corrugation density of the corrugations S1 is chosen to become less in the direction of the corrugationless regions. Alternatively, each corrugationless region may have a smaller or larger surface area than shown in FIGS. 2*a* and 2*b*. Also, a region with a smaller number of corrugations and density of corrugations compared with the wide region may be provided, instead of a corrugationless region, i.e. a region whose corrugation density is zero.

FIG. 2*b* shows the diaphragm M in perspective view for additional clarity. It is clearly visible here that the diaphragm M in its four diaphragm portions BM1, SM2, BM2, and SM1, arranged in pairs and merging into one another, is given a vaulty shape, which first of all renders possible a vibration of the diaphragm M, but also contributes to a stabilization of the diaphragm M.

Figure 3A:
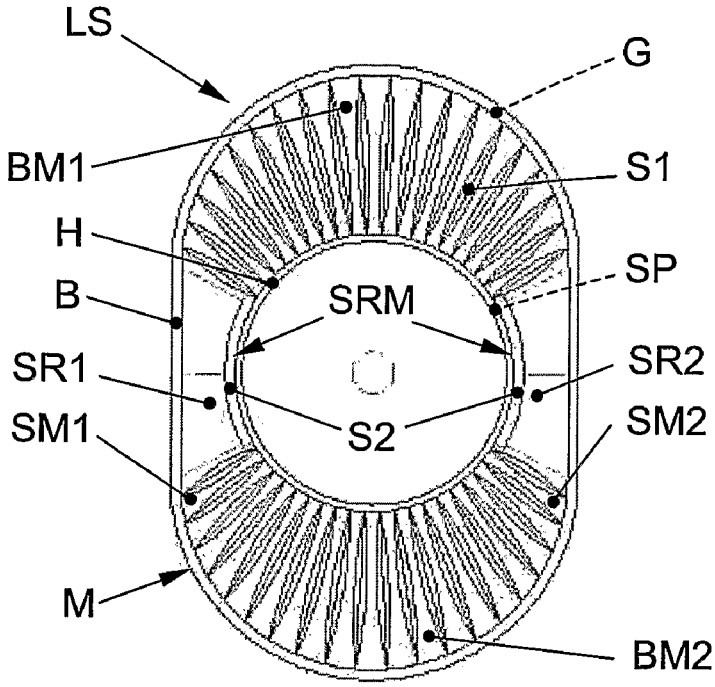
FIG. 3*a* shows in the same manner as FIGS. 1*a* and 2*a* a loudspeaker with a diaphragm in a second embodiment of the invention, which diaphragm comprises not only radially extending corrugations in two width regions, but also a circular additional corrugation extending concentrically with respect to a coil of the loudspeaker in each of two narrow regions.

FIG. 3*a* shows a loudspeaker LS similar to the loudspeaker LS of FIG. 2*a*, with a diaphragm M in which an additional corrugation S2 is provided in the region of each of the two narrow diaphragm portions, i.e. in the narrow regions SM1 and SM2, which additional corrugation S2 does not extend in radial direction from the inside to the outside, but extends in a direction that intersects the corrugation directions of the corrugations S1 adjoining the additional corrugation S2 in at least two points. In the example shown, the two additional corrugations S2 are shaped as circular arcs and run parallel to adjoining zones of the retaining part H, extending with their ends up to the wide diaphragm portions BM1 and BM2 provided with corrugations S1. The two additional corrugations S2 are arranged concentrically with the retaining part H in the present case. This is indeed advantageous, though not absolutely necessary, because the center of the circular arc corresponding to the respective additional corrugation S2 and the center of the circle corresponding to the retaining part H need not be identical, but may lie at some distance from one another.

Figure 3B:
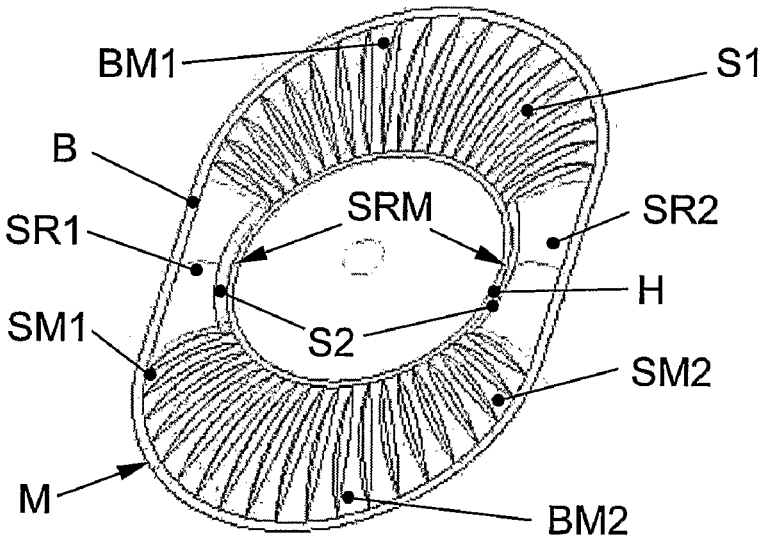
FIG. 3*b* shows in the same manner as FIGS. 1*b* and 2*b* the diaphragm of the loudspeaker of FIG. 3*a*.

The two additional corrugations S2 are to be regarded as part of the reducing means SRM of the diaphragm M of FIGS. 3*a* and 3*b*, which two additional corrugations S2 are provided in addition to the two stiffness-reducing portions SR1 and SR2 and are provided and constructed for additionally reducing the stiffness of the diaphragm M in the region of its two narrow diaphragm portions, i.e. the narrow regions SM1 and SM2. The two additional corrugations S2 in this case have a U-shaped cross-section of constant dimensions. The provision of the two additional corrugations S2, which each form a joint in the diaphragm to a certain extent, renders the stiffness of the diaphragm M in the region of its two narrow portions SM1 and SM2 even smaller than in the diaphragm of FIGS. 2*a* and 2*b*. It is possible as a result of this to equalize the mechanical properties of the diaphragm M in its two narrow regions SM1 and SM2 and in its two wide regions BM1 and BM2 in a particularly satisfactory and simple manner, so that the moving coil SP experiences practically no asymmetrical loads, and accordingly the disadvantages that can be caused by such asymmetrical loads are precluded.

The additional corrugations S2 are accordingly of particular advantage in cases in which it is no longer possible to stabilize the moving coil SP in its vibratory movement by means of a diaphragm M as shown in FIG. 2*a* because of the ratio between the length and the width of a loudspeaker LS and its diaphragm M, which are both elongated in shape. FIG. 3*b* shows the diaphragm M in perspective view for further clarification.

The loudspeakers according to the invention as described above are designed for incorporation in a device according to the invention. Such a device according to the invention may be a mobile telephone, a so-called PDA, a laptop computer, or a similar device. A device according to the invention is not shown in the drawings, but it is deemed to be included herein by reference.

It is finally noted that the invention is not limited to the embodiments of a diaphragm according to the invention and a loudspeaker according to the invention as described above. Indeed, the present invention is applicable to a plurality of constructions for loudspeakers, for example to elliptical or also substantially rectangular constructions of elongated loudspeakers with elongated diaphragms having cylindrical moving coils, or alternatively circular embodiments of loudspeakers and diaphragms which co-operate with non-circular moving coils, which moving coils have cross-sections of oval, elliptical, or rectangular shape with rounded corners. The moving coils need not necessarily have a circularly cylindrical construction here and need not be formed as moving coils made from coil wire by means of a coiling process, preferably formed as self-supporting coils, but the moving coils may alternatively be so-termed stacked coils which are obtained by stacking of planar, foil-type coil portions as is known, for example, from patent document US 2003/0016113 A1. Such stacked coils may be square in cross-section, rectangular, square with rounded corners, rectangular with rounded corners, or circular in shape. Instead of only one additional corrugation for each narrow diaphragm portion, i.e. for each narrow region SM1, SM2, two or three additional corrugations may alternatively be provided.

It should also be noted that the measures according to the invention may also be advantageously provided for a diaphragm in which a fastening part lies within the retaining part, in which case the moving coil is connected to the outermost retaining part of the diaphragm, and preferably also an additional sealing portion of the diaphragm is provided outside the retaining part, which sealing portion fulfills a sealing function and provides a separation of the air volume present in front of the diaphragm from the air volume present behind the diaphragm, so as to render possible the loudspeaker function.

The invention claimed is:

1. A diaphragm for a loudspeaker wherein said diaphragm comprises an annular fastening part and an annular retaining part one of said two parts lying within the other one of said two parts and wherein measurable minimum distances obtain between the retaining part and the fastening part different in value from one minimum distance to another minimum distance, such that at least one wide region and at least one narrow region are present, and wherein the diaphragm comprises corrugations which corrugations are provided between the retaining part and the fastening part and extend in corrugation directions from the interior to the exterior, and wherein reducing means are provided for reducing the stiffness of the diaphragm in its at least one narrow region.

2. A diaphragm as claimed in claim 1, wherein the reducing means in the at least one narrow region are formed by a particular arrangement of the corrugations in which arrangement the corrugation density is smaller than the corrugation density in the at least one wide region.

3. A diaphragm as claimed in claim 2, wherein the corrugation density in the at least one narrow region is only half that in the at least one wide region.

4. A diaphragm as claimed in claim 3, wherein the corrugation density in the at least one narrow region has a zero value.

5. A diaphragm as claimed in claim 1, wherein the reducing means in the at least one narrow region comprise at least one additional corrugation which additional corrugation extends in a direction such that said direction and the corrugation directions of the corrugations adjoining the additional corrugation intersect in at least two points.

6. A diaphragm as claimed in claim 5, wherein the retaining part is given a circular shape, and wherein the additional corrugation is given the shape of a circular arc so as to run parallel to an adjoining zone of the retaining part.

7. A diaphragm as claimed in claim 5, wherein the additional corrugation has a U-shaped cross-section.

8. A diaphragm as claimed in claim 5, wherein the additional corrugation has the same cross-section throughout its entire longitudinal dimension.

9. A diaphragm as claimed in claim 1, wherein the retaining part is given the shape of a circle.

10. A loudspeaker with a diaphragm wherein the loudspeaker is provided with a diaphragm as claimed in claim 1.

11. A device comprising a loudspeaker wherein the device is provided with a loudspeaker as claimed in claim 10.

* * * * *